US007703244B2

(12) United States Patent
Suzuki et al.

(10) Patent No.: US 7,703,244 B2
(45) Date of Patent: Apr. 27, 2010

(54) JOINT STRUCTURE USING A GUSSET PLATE, A BUILDING USING THE JOINT STRUCTURE AND A METHOD OF ASSEMBLING OR REINFORCING A BUILDING

(75) Inventors: Kazuaki Suzuki, Chiyoda-ku (JP); Yasushi Maeda, Chiyoda-ku (JP); Tooru Takeuchi, Chiyoda-ku (JP)

(73) Assignee: Nippon Steel Corporation, Tokyo (JP)

( * ) Notice: Subject to any disclaimer, the term of this patent is extended or adjusted under 35 U.S.C. 154(b) by 1279 days.

(21) Appl. No.: 10/829,275

(22) Filed: Apr. 22, 2004

(65) Prior Publication Data

US 2004/0211140 A1 Oct. 28, 2004

(30) Foreign Application Priority Data

Apr. 25, 2003 (JP) ..... 2003-121839

(51) Int. Cl.
*E04B 1/98* (2006.01)
*E04H 9/02* (2006.01)

(52) U.S. Cl. ..... 52/167.3; 52/167.1; 52/655.1; 52/393; 403/217; 403/169

(58) Field of Classification Search ..... 52/93.1, 52/167.3, 393, 395, 656.9, 694, 646, 632, 52/645, 695, 167.1, 655.1, 653.1; 403/219, 403/181, 217, 169, 170, 174
See application file for complete search history.

(56) References Cited

U.S. PATENT DOCUMENTS 3,458,647 A * 7/1969 Fouse ..... 174/84 R
3,474,578 A * 10/1969 Wippermann ..... 52/92.3
4,047,341 A * 9/1977 Bernardi ..... 52/729.1
4,347,015 A * 8/1982 Olashaw ..... 403/219
4,409,765 A * 10/1983 Pall ..... 52/167.1
4,548,014 A * 10/1985 Knowles ..... 52/693
4,773,193 A * 9/1988 Biebuyck et al. ..... 52/93.1
4,957,186 A * 9/1990 Reetz ..... 248/284.1
5,375,389 A * 12/1994 Kimura ..... 52/698
5,533,307 A * 7/1996 Tsai et al. ..... 52/167.3

(Continued)

FOREIGN PATENT DOCUMENTS

JP 2533935 B2 6/1996

(Continued)

OTHER PUBLICATIONS

McCormac, Jack C., Structural Steel Design, Second Edition, Chapters 10 and 17.*

*Primary Examiner*—Richard E Chilcot, Jr.
*Assistant Examiner*—Mark R Wendell
(74) *Attorney, Agent, or Firm*—Birch, Stewart, Kolasch & Birth, LLP

(57) ABSTRACT

A joint structure includes a splice plate and a gusset plate, which can prevent out-of-plane buckling of the gusset plate without the necessity of welding a stiffening rib plate thereon. The joint structure includes a gusset plate and at least one splice plate connected to the gusset plate. Each of the splice plates is constructed from section steel having a non-rectangular cross-section. The joint structure can be used in a building during assembly of the building or for reinforcement of the building.

35 Claims, 12 Drawing Sheets

U.S. PATENT DOCUMENTS

| | | | | |
|---|---|---|---|---|
| 5,660,017 | A * | 8/1997 | Houghton | 52/655.1 |
| 5,827,006 | A * | 10/1998 | Hoshino | 403/340 |
| 5,893,253 | A * | 4/1999 | Lutz, III | 52/695 |
| 6,298,630 | B1 | 10/2001 | VeRost et al. | |
| 6,499,266 | B1 * | 12/2002 | Macumber | 52/694 |
| 6,591,573 | B2 * | 7/2003 | Houghton | 52/656.9 |
| 6,826,874 | B2 * | 12/2004 | Takeuchi et al. | 52/167.3 |
| 6,837,010 | B2 * | 1/2005 | Powell et al. | 52/167.3 |
| 7,225,588 | B2 * | 6/2007 | Nakamura et al. | 52/167.3 |
| 2003/0009977 | A1 * | 1/2003 | Houghton | 52/656.9 |
| 2004/0074161 | A1 * | 4/2004 | Kasai et al. | 52/167.1 |
| 2004/0107654 | A1 * | 6/2004 | Powell et al. | 52/167.3 |
| 2005/0005539 | A1 * | 1/2005 | Nakamura et al. | 52/167.3 |
| 2005/0036829 | A1 * | 2/2005 | Trull | 403/170 |
| 2005/0166487 | A1 * | 8/2005 | Tsai | 52/167.3 |
| 2006/0112652 | A1 * | 6/2006 | Ichikawa et al. | 52/167.1 |
| 2007/0240368 | A1 * | 10/2007 | Tsai et al. | 52/167.3 |

FOREIGN PATENT DOCUMENTS

| | | | |
|---|---|---|---|
| JP | 11-117404 | B2 | 4/1999 |
| JP | 3295007 | B2 | 4/2002 |
| JP | 2003-34984 | A | 2/2003 |

* cited by examiner

JOINT STRUCTURE USING A GUSSET PLATE, A BUILDING USING THE JOINT STRUCTURE AND A METHOD OF ASSEMBLING OR REINFORCING A BUILDING

CROSS-REFERENCE TO RELATED APPLICATIONS

This nonprovisional application claims priority under 35 U.S.C. § 119(a) on Patent Application No. 2003-121839, filed in Japan on Apr. 25, 2003, the entirety of which is incorporated herein by reference.

BACKGROUND OF THE INVENTION

1. Field of the Invention

The present invention relates to a joint structure including a gusset plate and at least one splice plate and a building using the joint structure. The present invention also relates to a method of assembling or reinforcing a building using the joint structure.

2. Description of Background Art

Truss structures for buildings include a column-beam joining part and/or a panel point part. At the location of the column-beam joining part and/or the panel point part, a diagonal member is connected via a gusset plate to an axial force member. The diagonal member can be a structural member or a vibration-damping brace, for example. The axial force member intersects with the diagonal member at a predetermined angle. The gusset plate used in such a joint structure is designed not to cause out-of-plane buckling and/or out-of-plane deformation when a compression force is applied to the diagonal member. Out-of-plane buckling and out-of-plane deformation refer to the plane formed by a smooth side surface of the gusset plate 21, where a splice plate 22 is to be connected as shown in FIG. 2 of the present invention. The plane being referred to is not an inclined joining end edge 30 of the gusset plate 21.

Referring to FIGS. 7A-7D and 8A-8D below, examples of the above joint structure will be described. FIGS. 7A and 7B illustrate a first example according to the background art. FIGS. 7C and 7D illustrated a second example according to the background art. FIGS. 8A and 8B illustrated a third example according to the background art. FIGS. 8C and 8C illustrated a fourth example according to the background art. Each of the above-mentioned figures illustrates a joint structure including a joining end part 4 of a diagonal member 3, such as a structural member or a vibration damping brace, joined with a gusset plate 1 by using a splice plate 2. The end part 4 has a cross-section, which is cruciform in shape, i.e., cross-shaped in cross-section.

In example 1 of the background art illustrated in FIGS. 7A and 7B, a vertical joining plate 5 is fixed on a vertical edge of the gusset plate 1. The vertical joining plate 5 is connectable to a structural member such as a column or one of the axial force members of a truss structure (not shown). The vertical edge of the gusset plate 1 makes a right angle with a bottom horizontal edge of the gusset plate 1. In addition, a horizontal joining plate 6 is fixed on the horizontal edge of the gusset plate 1. The horizontal joining plate 6 is connectable to a structural member such as a beam or the other of the axial force members of the truss structure (not shown). A top horizontal edge 7 extends from the top end of the vertical edge of the gusset plate 1 and a vertical up-right edge 8 extends upward from an end of the bottom horizontal edge of the gusset plate 1 opposite to where the vertical joining plate 5 is fixed. The top horizontal edge 7 and the vertical up-right edge 8 are connected via an inclined joining end edge 10.

A stiffening rib plate 11 is welded at weld 12 on opposite sides of the gusset plate 1 to form a stiffening part with the gusset plate 1. Therefore, the stiffening part has a cross-section, which is cruciform in shape, i.e., cross-shaped in cross-section. The joining end part 4 of the diagonal member 3, which also has a cruciform cross-section, is abutted against the inclined joining end edge 10 of the gusset plate 1. The end edge 10 of the gusset plate 1 is located on the end edge of the stiffening part having a cruciform cross-section. As mentioned above, the diagonal member 3 is, for example, a structural member or a vibration-damping brace.

A splice plate 2 according to the background art is in the form of a rectangular flat plate having a rectangular cross-section. Referring to FIGS. 7B, 7D, 8B and 8D, a portion of each of four splice plates 2 is secured by bolts 13 to each side of the four wings forming the cruciform, i.e., both of the stiffening rib plates 11 and 11 and two portions of gusset plate 1. Each of the splice plates 2 is located on opposite sides of the rib plate 11. The remaining portion of each of the splice plates 2 is secured to each side of the four wings of the joining end part 4 of the diagonal member 3 in the same way as described above.

In example 1 according to the background art, the joining end part 4 of the diagonal member 3 is joined to the gusset plate 1 through the splice plates 2 in the construction described above.

In example 2 according to the background art, as illustrated in FIGS. 7C and 7D, stiffening ribs 14 and 15 are welded to the top horizontal edge 7 and the vertical up-right edge 8 of the gusset plate 1, respectively. In addition, the stiffening rib plate 11 is welded to the gusset plate 1 as described above in the construction according to example 1 of the background art. The stiffening ribs 14 and 15 are used to further prevent out-of-plane buckling or deformation of the gusset plate 1.

FIGS. 8A and 8B illustrate example 3 according to the background art and FIGS. 8C and 8D illustrate example 4 according to the background art. In example 3 illustrated in FIGS. 8A and 8B, the construction is the same as example 1, except that the stiffening rib plate 11 welded to opposite sides of the gusset plate 1 does not extend below a bottom edge of the splice plates 2. In example 4 illustrated in FIGS. 8C and 8D, the construction is the same as example 1, except that the stiffening rib plate 11 welded to opposite sides of the gusset plate 1 extends to the vertical joining plate 5.

In examples 1-4 according to the background art, the stiffening rib plates 11 are welded to opposite sides of the gusset plate 1 so that the gusset plate 1 does not experience out-of-plane buckling and/or out-of-plane deformation when a compression force is applied to the diagonal member 3. However the welding operation takes time, which leads to an increase in the cost of the joint structure and therefore the building in which the joint structure is used.

In addition, if a gusset plate according to the background art is reinforced with a stiffening rib for increasing earthquake resistance, the stiffening rib has to be fixed by welding. Furthermore, if the stiffening rib is welded on site, (1) it leads to an increase in cost, (2) it is subject to the weather, and (3) it may require upward-welding, which results in a low quality weld.

It is necessary to weld the stiffening rib 11 to the gusset plate 1 to compensate for a lack of strength, since the splice plate 2 is in the form of a rectangular flat plate having a rectangular cross-section. The present inventors have determined that a rectangular flat plate does not contribute to a sufficient increase in the buckling strength of the gusset plate 1 to avoid out-of-plane buckling.

The stiffening ribs 14 and 15 welded to the top horizontal edge 7 and the vertical up-right edge 8, respectively, as illustrated in FIG. 7C can increase the buckling strength of the gusset plate 1. However, it is necessary to weld the stiffening ribs 14 and 15 to the gusset plate 1. Accordingly, example 2 of the background art has the same welding problems mentioned above.

As shown in FIG. 8A, if the length of the splice plate 2 contacting the gusset plate 1 on the side surface of the gusset plate 1 is decreased in length, the strength of the joint structure decreases. Accordingly the possibility of out-of-plane buckling and/or deformation increases. As shown in FIG. 8C, if the stiffening rib plate 11 extends to the lower end of the gusset plate 1 to reach the vertical joining plate 5, the strength of the joint structure increases. Accordingly, the possibility of out-of-plane buckling and/or deformation is improved. However, the stiffening rib plate must be welded to the gusset plate 1. Accordingly, the same welding problems described above still remain.

Thus problems in the background art are summarized as follows:

(1). If the stiffening rib plate. 11 for preventing out-of-plane buckling is not fixed to the gusset plate 1, the gusset plate experiences out-of-plane buckling when a compression force is applied to the diagonal member 3. Therefore the stiffening rib plate 11 must be welded to the gusset plate 1 to prevent out-of-plane buckling and/or out-of-plane deformation in the background art.

(2). In the gusset plate 1 with the stiffening rib plate 11, which forms a cruciform cross-section with the gusset plate 1, if the length of the stiffening rib plate 1 fixed to the gusset plate is short, out-of-plane buckling and/or deformation occurs.

(3). A stiffening rib plate 11 welded to the gusset plate 1 is inevitable in the examples according to the background art. The stiffening rib plate must be welded to the gusset plate 1, thereby increasing the cost of the joint structure. Also, if the gusset plate 1 according to the background art is reinforced with a stiffening rib for increasing earthquake resistance, the stiffening rib has to be fixed by welding. Furthermore, if the stiffening rib is welded on site, (1) it leads to an increase in cost, (2) it is subject to the weather, and (3) it may require upward-welding, which results in a low quality weld.

SUMMARY OF THE INVENTION

An object of the present invention is to provide a joint structure using a gusset plate and a building using the joint structure, which can solve the above-mentioned problems of the background art. In addition, an object of the present invention is to provide a method of assembling or reinforcing a building using the joint structure of the present invention, which can solve the above-mentioned problems of the background art.

According to a first aspect of the present invention, a joint structure, comprises a gusset plate; and at least one splice plate connected to said gusset plate, said at least one splice plate being constructed from section steel having a non-rectangular cross-section.

A second aspect of the present invention is directed to a building including the joint structure of the first aspect of the present invention. Specifically, a building comprises at least one structural member; and a joint structure connected to said at least one structural member, said joint structure comprising: a gusset plate; and at least one splice plate connected to said gusset plate, said at least one splice plate being constructed from section steel having a non-rectangular cross-section.

A third aspect of the present invention is directed to a method of assembling or reinforcing a building, comprising the steps of providing a gusset plate and at least one splice plate, said splice plate having a non-rectangular cross-section; and connecting a first end of said splice plate to said gusset plate.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1C:
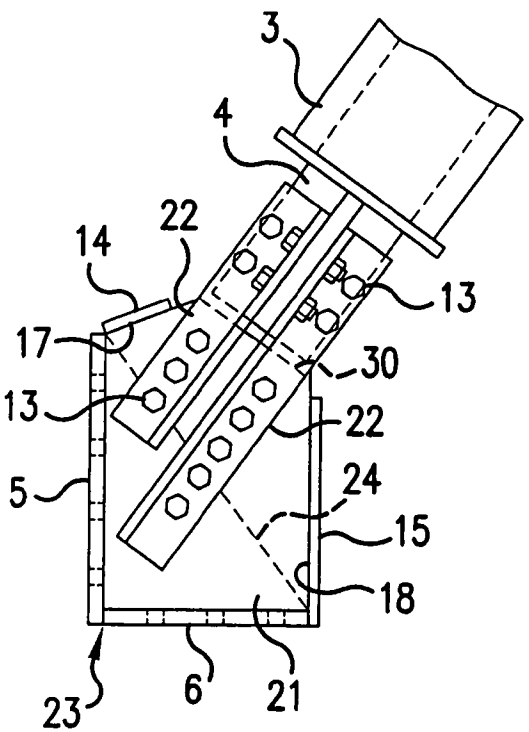
FIGS. 1A, 1B and 1C are side views illustrating a joint structure including a gusset plate and a splice plate according to embodiments 1-3, respectively, of the present invention.

The present invention will now be described with reference to the accompanying drawings, wherein the same or similar elements have been identified using the same reference numerals.

FIGS. 1A-1C and FIGS. 2A-2C illustrate embodiments 1-3 of the present invention, respectively. As shown in FIGS. 1A-1C and FIGS. 2A-2C, a joining end part 4 of a diagonal member 3 is joined with a gusset plate 21 by using a splice plate 22. The splice plate 22 has a non-rectangular cross-section instead of using the rectangular plate having a rectangular cross-section according to the background art. The splice plate 22 is formed by fixing a rib to a flat plate and/or by using prefabricated section steel having a non-rectangular cross-section. The diagonal member can be a structural member or a vibration damping brace.

The non-rectangular cross-section of the splice plates refers to any cross-sectional shape, other than the rectangular shaped cross-section of a flat plate. The non-rectangular cross-section typically includes cross-sections of angled steel having a right angle, i.e., L-shaped, or having other angles of varying degrees. In addition, non-rectangular cross-sections include T-shapes prefabricated section steel and C-shaped (channel shaped) prefabricated section steel. However, it should be understood that the non-rectangular cross-sections should not be limited to such cross-sections. For example, more complicated shaped cross-sections can be included in the present invention as long as the particularly shaped splice plate can provide reinforcement to the joint structure as compared to a splice plate constructed from a flat plate as in the background art.

The splice plate can be joined to the gusset plate with bolts, adhesive joining or diffusion joining. These types of connection are recommended to avoid on site upward-welding as much as possible. Any other joining method that avoids the necessity of upward welding can also be used to avoid the problems associated with upward-welding.

One typical example of a joint structure using a gusset plate is where the gusset plate is fixed in a corner formed between first structural members such as between a column and beam in a column-beam or truss frame. The gusset plate is then connected to another structural member or vibration damping brace, for example, extending diagonally from the corner of the first structural members. However, it should be understood that the joint structure of the present invention can be used to connect other members together as well.

The materials used for the rib attached to the flat plate to form the splice plate having a non-rectangular cross section is not limited to specific materials. However, the rib can be made from materials including ordinary steel and special steel such as stainless steel, as long as the material meets strength requirements. In addition, the rib can be in the form of a flat plate having a rectangular cross section or a plate having an S-shaped or L-shape cross-section in order to provide more strength. The rib can then be attached to the flat plate to form the splice plated having a non-rectangular cross-section. Alternatively, the splice plate can be prefabricated to have a particular non-rectangular cross-section.

If the rib is welded to the flat plate to form a splice plate having a non-rectangular cross-section, it is preferred that the rib be made of steel material such as ordinary steel or stainless steel when the splice plate is made of steel. If welding is not used for fixing the rib, nonferrous metals or inorganic materials can be used, as long as the splice plate has a sufficient buckling strength.

With regard to the prefabricated section steel used in the present invention, equal sided angle steel, unequal sided angle steel, C-shaped (channel shaped) prefabricated section steel and T-shaped prefabricated section steel can be used. In addition, the prefabricated section steel is not limited to ordinary steel, but stainless steel, high alloy-containing special steel, nonferrous metals or inorganic materials can also be used. It should also be noted that the prefabricated section steel includes section steel formed by connecting two or more plates together to form a non-rectangular cross-section, while the plates are off the assembly site. Of course, the section steel used to make the splice plates in the present invention do not have to be made from prefabricated section steel. In other words, the splice plates can be made to have a non-rectangular cross-section by connecting two or more plates together to form a non-rectangular cross-section on the assembly site as well.

The recitation column-beam structures refers to any structural members which have the function of bearing both an axial force and a bending force. However, it should be understood that the column-beam structures are not be limited only to columns and beams literally. Truss frame structures refer to any structural members, which have the function of primarily bearing only an axial force; however, it should be understood that the truss frame structures are not limited only to truss frame structures literally.

It should also be understood that a structural member in the present invention is not limited to one, which is placed horizontally or vertically. In addition, a diagonal member is one, which is connected to a column and/or beam diagonally by using a gusset plate. Diagonal members are typically connected to the corner of the column and beam where a right angle is formed by. using a gusset plate. However, diagonal members are not limited to members extending diagonally from a corner with a right angle. Furthermore, a structural member of a truss frame does not have to be a straight member, but can be a curved member.

The edges of the gusset plate refer to the faces of the gusset plate extending in the thickness direction of the gusset plate. The side faces of the gusset plate refer to the faces where the splice plate is attached and fixed, usually perpendicular to the end face.

The ribs fixed to the edges of the gusset plate can increase the buckling strength of the gusset plate. The ribs fixed to the side faces of the gusset plate can provide further improvement in buckling strength when the rib is nipped by a pair of splice plates and fixed thereto.

The ribs are fixed to the gusset plate usually at a right angle; however, a right angle is not required. Each rib on opposite side faces of the gusset plate is usually fixed to the gusset plate to make the cross-section of the rib and gusset plate form a cruciform. However, it is not necessary to fix the rib to the gusset plate to make a cruciform cross-section. For example, the rib can be fixed on only one side face of the gusset plate, so that the cross-section is T shaped.

With regard to the length of the ribs fixed to the gusset plate, it depends on the strength required to prevent out-of-plane buckling. The rib can also be divided into plural portions if necessary. Adhesive joining or diffusion joining can also be used to join the rib to the gusset plate.

Figure 1B:
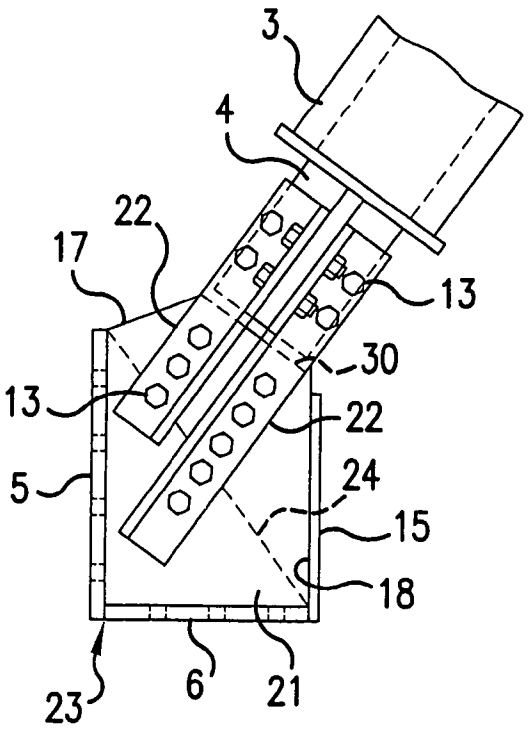
Figure 1A:
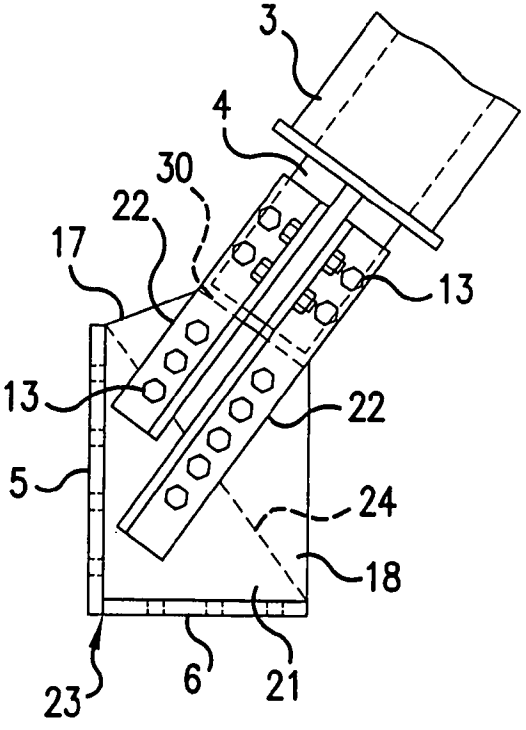
Figure 2A:
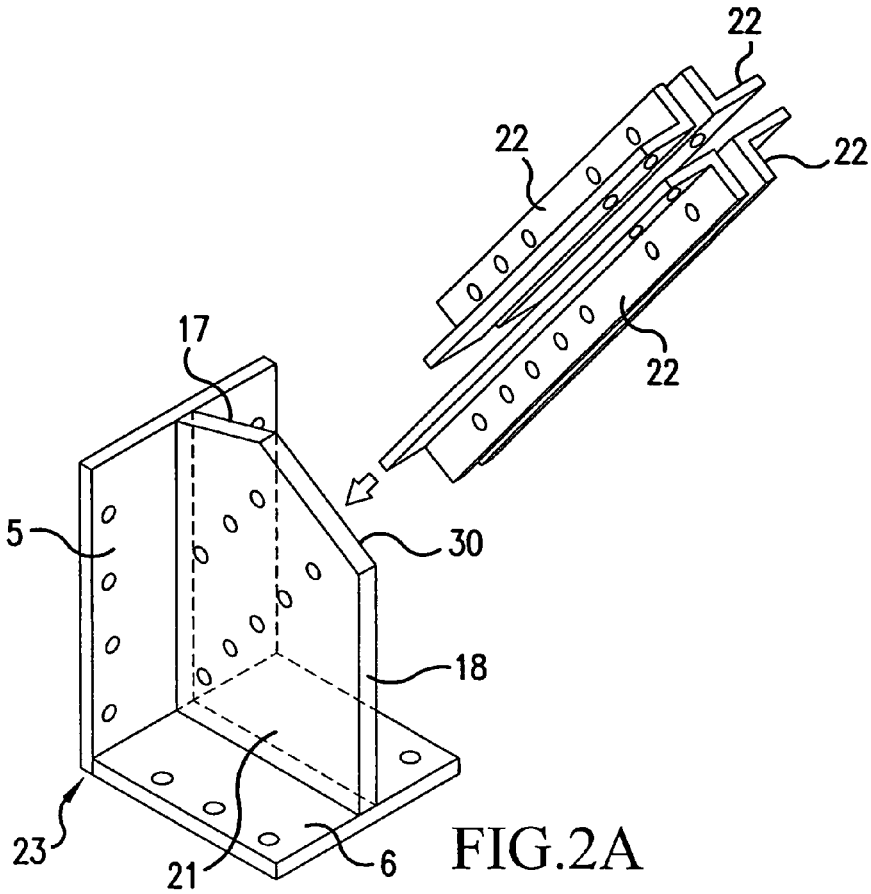
FIGS. 2A, 2B and 2C are perspective views illustrating a joint structure including a gusset plate and a splice plate according to embodiments 1-3, respectively, of the present invention.

In embodiment 1 illustrated in FIG. 1A and FIG. 2A, the gusset plate 21 includes a vertical joining plate 5 and a horizontal joining plate 6. A column or one axial force member of a truss structure (not shown) is connectable to the vertical joining plate 5 and a beam or another axial force member of the truss structure (not shown) is connectable to the horizontal joining plate 6.

A top inclined edge 17 extends from the top end of the vertical edge of the gusset plate 21 and a vertical up-right edge 18 extends upward from the end of the bottom horizontal edge of the gusset plate 21 opposite to the vertical joining plate 5. The top inclined edge 17 and the vertical up-right edge 18 are connected via an inclined joining end edge 30.

A joining end part 4 of the diagonal member 3 has a cruciform cross-section, i.e., a cross-shaped cross-section, and is abutted against the inclined joining end edge 30 of the gusset plate 21. The diagonal member 3 can be a structural member or a vibration-damping brace, which diagonally extends from above.

As shown in FIGS. 1A and 2A, the lower portion of the four splice plates 22 with an L-shaped cross-section are constructed from L-shaped prefabricated section steel. The splice plates 22 are attached to opposite side faces of the gusset plate 21, respectively, and are fixed thereto with bolts 13. The upper portion of the splice plates 22 project diagonally upward from the inclined joining end edge 30.

The upper portions of the splice plates 22 are bolted to the joining end part 4 of the diagonal member 3 after the joining end part 4 is abutted against the inclined joining end edge 30 of the gusset plate 21. The lower ends of the splice plates 22 extend toward a corner 23 of the gusset plate 21 so that sufficient strength can be obtained to avoid out-of-plane buckling and/or deformation. The out-of-plane buckling will now be explained below when there are no stiffening ribs 14, 15 or stiffening rib plates 11 on the gusset plate 21.

Out-of-plane buckling occurs in the gusset plate 21 along a yield line, which can be defined by what is known as the yield line theory. Referring to FIG. 1A, the yield line of the gusset plate 21 corresponds to an inclined line 24 (dashed line), which connects a top end point of the vertical joining plate 5 (the vertical edge of the two edges of the gusset plate 21 that make a right angle with each other) and an end point of the horizontal joining plate 6 (the bottom horizontal edge of the two edges of the gusset plate 21 that make a right angle with each other).

A strength which is sufficient to avoid out-of-plane buckling can be obtained by extending the splice plate 22 diagonally downwardly beyond the inclined line 24 to get close to the corner 23 of the gusset plate 21. The degree of strength to prevent out-of-plane buckling is controllable by adjusting the length of the splice plate 22 extending beyond the line 24 and/or the strength of the splice plate. In the case of embodiments 1-3 illustrated in FIGS. 1A-1C, respectively, the upper splice plate 22 has a short length, but still extends beyond the inclined line 24, and the lower splice plate 22 has a longer length, which extends close to the corner 23 of the gusset 21. If a splice plate formed with T-shaped prefabricated section steel (not shown) is used, rather than L-shaped prefabricated section steel, some portions of the T-shaped prefabricated section steel close to the corner 23 of the gusset plate 21 can be cut off.

In embodiment 1 illustrated in FIGS. 1A and 2A, the splice plate 22 is formed by fixing a rib to a flat plate and/or by using prefabricated section steel with a cross-section of non-rectangular shape. In embodiments 1-3, illustrated in FIGS. 1A-1C, the splice plate has an L-shaped cross-section, which provides a high stiffness. Therefore, it is possible to prevent out-of-plane buckling and/or out-of-plane deformation caused by a compression force applied to the diagonal member 3 without the necessity of welding a stiffening rib plate on the gusset plate 21. Furthermore, it is also possible to cope with a greater compression force applied to the diagonal member 3 by adjusting a length of the portion of the splice plate 22 beyond the yield line.

Figure 2B:
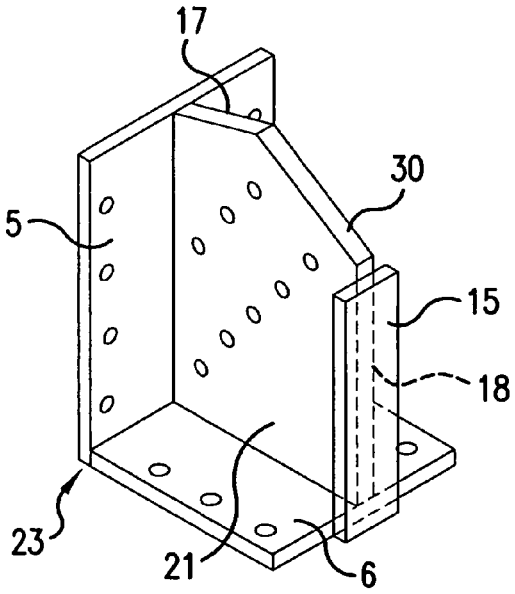
Figure 2C:
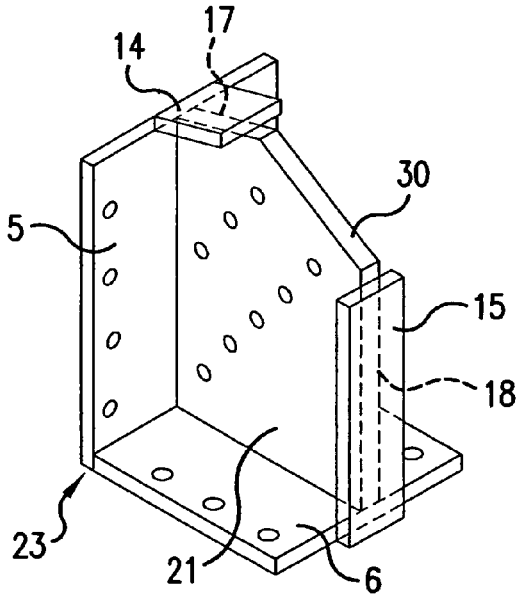

FIGS. 1B and 2B illustrate embodiment 2. Embodiment 2 is the same as embodiment 1, except that a stiffening rib 15 having a predetermined height is welded to the vertical up-right edge 18 of the gusset plate 21. FIGS. 1C and 2C illustrate embodiment 3. Embodiment 3 is the same as embodiment 2, except that another stiffening rib 14 is welded to the top inclined edge 17 of the gusset plate 21.

In embodiments 2 and 3, the buckling strength of the gusset plate 21 is further increased by fixing the stiffening rib 15 and the stiffening rib 14 to the vertical up-right edge 18 and to the top inclined edge 17, respectively, of the gusset plate 21.

In embodiments 1-3 of the present invention, the joining end part 4 of the diagonal member 3 has a cruciform shaped cross-section. It should be understood that the present invention is not limited to a joining end part having a cruciform shaped cross-section, but can be applied to a joint end part having a different cross section. For example, the present invention can be applied to a joining end part made of a flat plate and having a rectangular cross-section.

Figure 3:
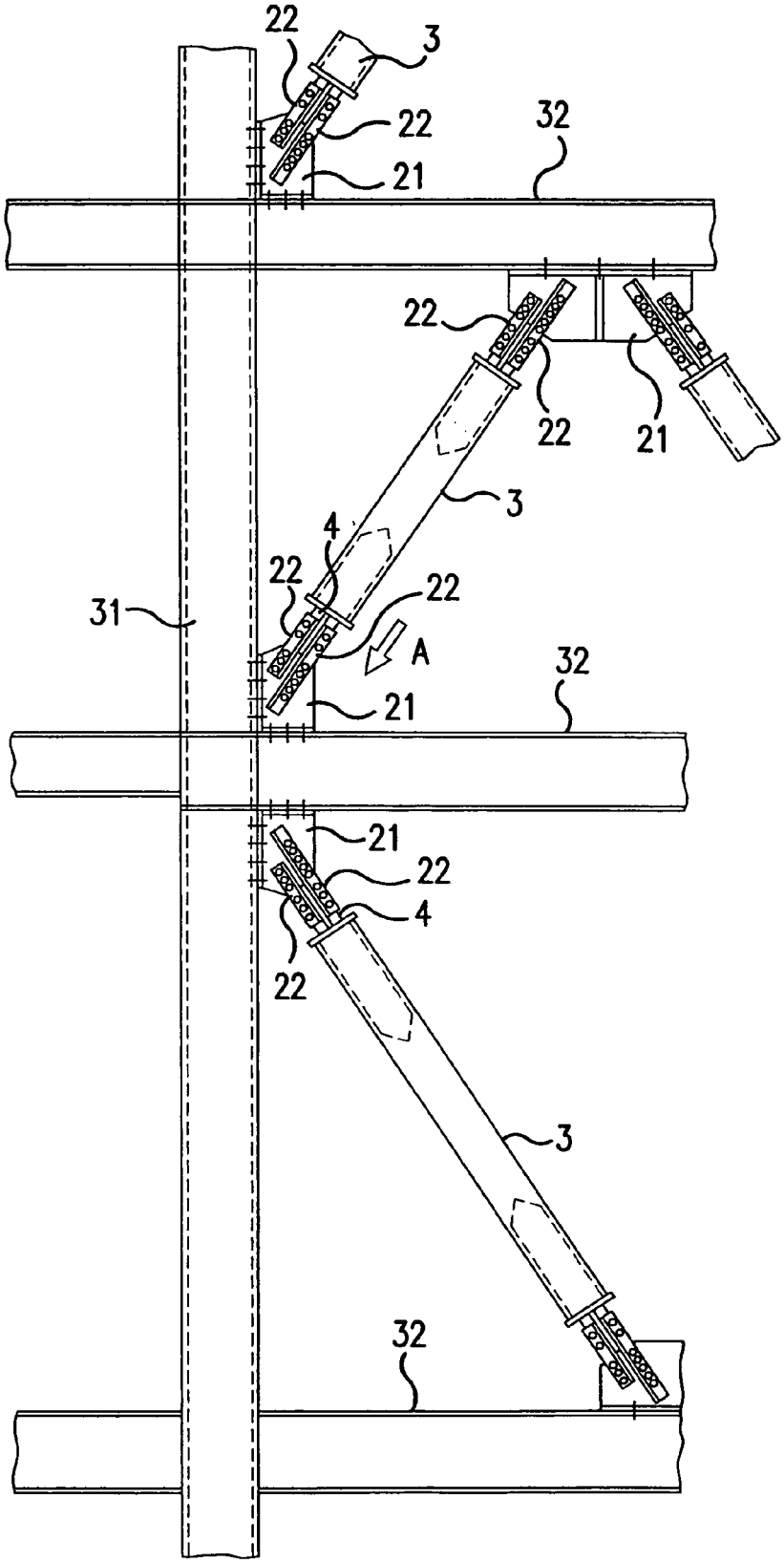
FIG. 3 is a side view illustrating a truss frame using a joint structure of embodiment 1 of the present invention.
Figure 4:
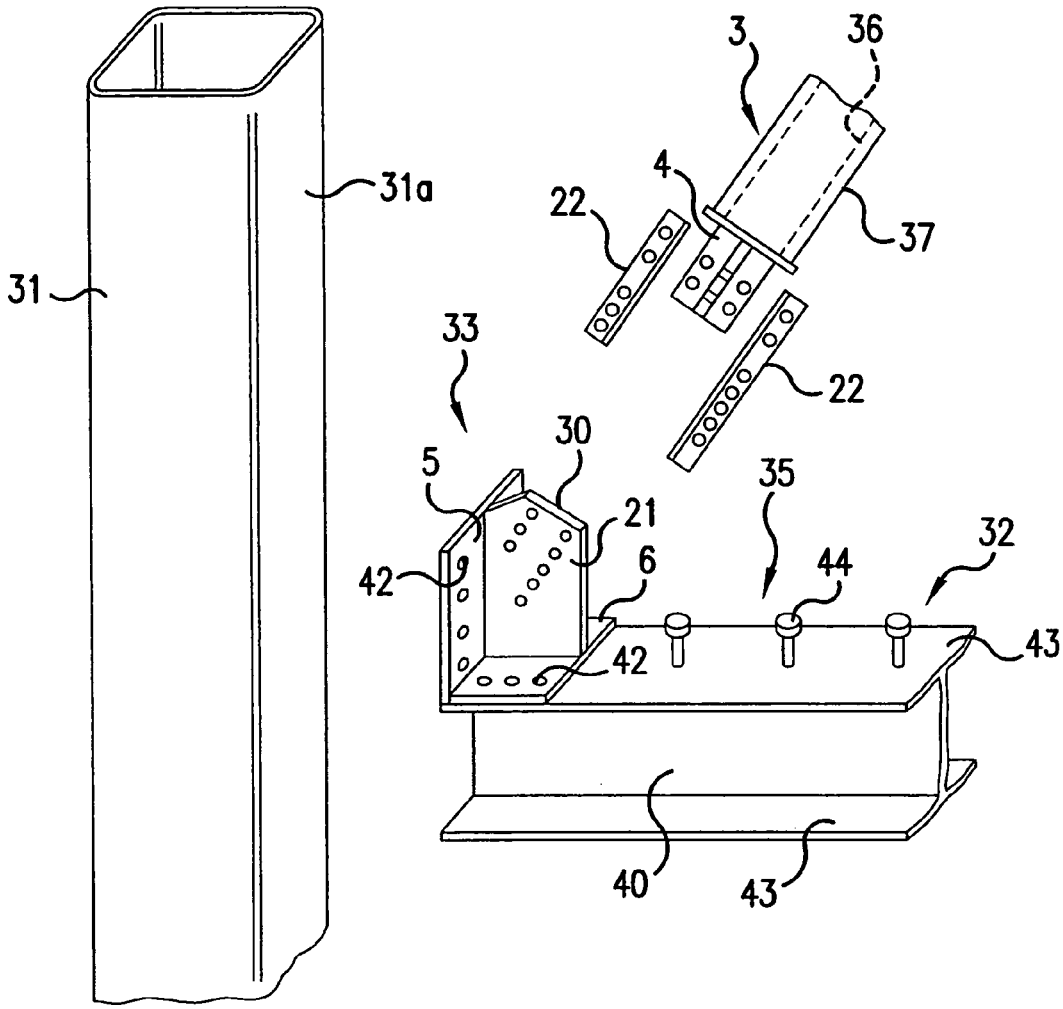
FIG. 4 is an exploded perspective view of part A of FIG. 3.
Figure 5B:
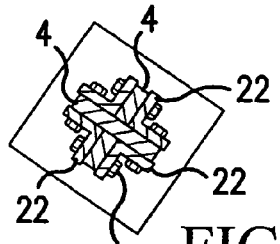
FIG. 5B is a cross sectional view taken along the line 5B-5B of Figure.
Figure 5A:
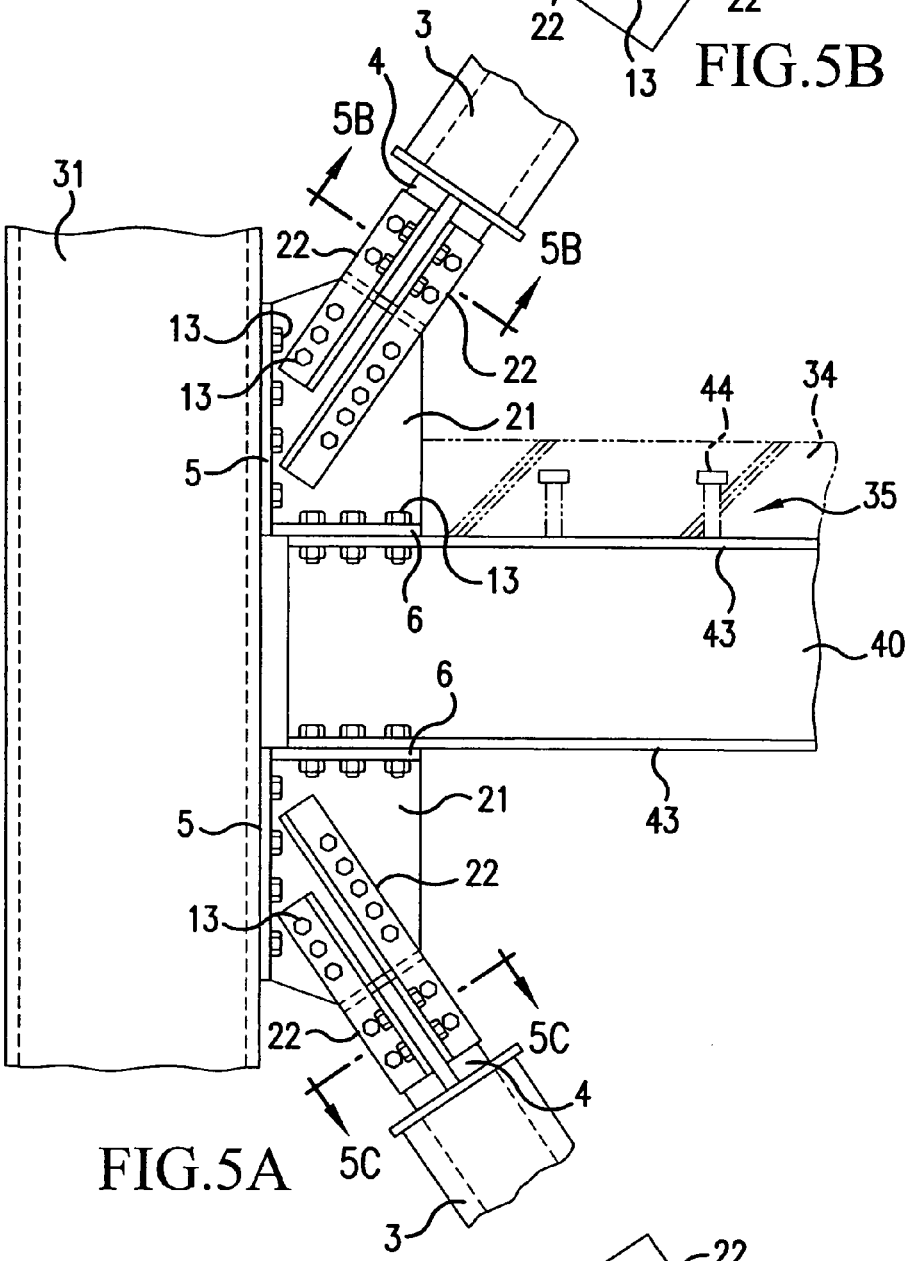
FIG. 5A is an enlarged view of part A of FIG. 3.
Figure 5C:
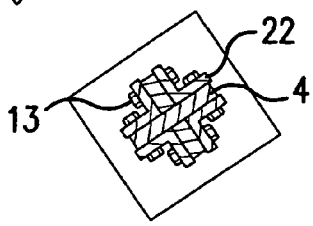
FIG. 5C is a cross sectional view taken along the line 5C-5C of FIG. 5A.

In FIG. 3, an example is illustrated, where a joint structure according to embodiment 1 of the present invention is applied to a steel frame including a column 31 having a box-shaped cross-section, a beam 32 of H-prefabricated section steel and a vibration damping brace (diagonal member) 3. FIG. 4 and FIGS. 5A-5C illustrate the details of the joint structure shown in FIG. 3.

A vibration damping brace 3 is diagonally disposed between a joint part located on a beam 32 and another joint part located in the corner between another beam 32 and a column 31. One end of the vibration damping brace 3 is joined to the column 31 and the beam 32 through a vertical/horizontal force transmitting mechanism 33. A horizontal force transmitting mechanism 35 for transmitting a horizontal force to a floor structure 34 (see FIG. 5A) is set up on the beam 32.

The vibration damping brace 3 can be formed by stiffening a core member 36 with a buckling restraining member such as a steel pipe, a steel pipe and concrete, or reinforced concrete so as to have a vibration damping function. A joining end part 4 of the core member 36 has a cruciform cross section.

The procedure for assembling each of the above-described members will be described below. First, a beam 32 with an upper gusset plate 21 and a lower gusset plate 21 is held against one side 31*a* (see FIG. 4) of a column 31. The upper and lower gusset plates 21 are then fixed to the beam 31 using bolts. Specifically, a vertical joining plate 5 of the upper gusset plate 21 is bolted to the side 31*a* of the column 31 and a horizontal joining plate 6 is bolted to the upper flange 43 of the beam 32. In addition, a joining plate 5 of the lower gusset plate 21 is bolted to the side 31*a* of the column 31 and a horizontal joining plate 6 is bolted to the lower flange 43 of the beam 32.

Second, a joining end part 4 of the vibration damping brace 3 having a cruciform cross-section is abutted against the inclined joining end edge 30 of the gusset plate 21. A splice plate 22 with a non-rectangular cross-section, which is formed by fixing a rib to a flat plate and/or by using prefabricated section steel having a non-rectangular cross-section, is arranged over the joining end part 4 and the gusset plate 21. The joining end part 4 and one portion of the splice plate 22 facing the joining end part 4 are fixed together by bolts 13, and the gusset plate 21 and the other portion of the splice plate 22 facing the gusset plate 21 are fixed together by bolts 13. Thus the vertical force and horizontal force transmitting mechanism 33 is constructed to transmit the force from the vibration damping brace 3 to the column 31 and the beam 32.

After assembling a column 31, a beam 32 and a vibration damping brace member (diagonal member) 3 through a vertical/horizontal force transmitting mechanism 33, concrete is placed to form a floor structure 34 so that an upper flange 43 of the beam 32 is covered and a shear connecter 44 is buried, which forms a horizontal force transmitting mechanism 35 for transmitting a force from the beam 32 to the floor structure 34.

In an earthquake-proof structure, the column 31, the beam 32, the vibration damping brace member 3 and the floor structure 34 are connected through the vertical/horizontal force transmitting mechanism 33. Accordingly, when a force is applied to the vibration damping brace member 3 in an axial direction, the vertical component and the horizontal component of the force are transmitted to the column 31 and the beam 32, respectively, through the gusset plate 21 and the bolts 13, which fix the gusset plate 21 to the column 31 and the beam 32.

In FIG. 4 and FIGS. 5A-5C, the gusset plate 21 and the joining end part 4 of the diagonal member (vibration damping brace) 3 are spliced by using the splice plate 22 of the present invention having a non-rectangular cross-section. The splice plate 22 is formed by attaching a rib to a flat plate and/or by using prefabricated section steel in a particular shape. The gusset plate 21 and the joining end part 4 are fixed to the splice plate 22 by bolts 13. Thus, out-of-plane buckling and/or out-of-plane deformation can be avoided without welding a stiffening rib plate 11 on the gusset plate 21, even if a compression force is applied to the diagonal member 3.

Figure 6A:
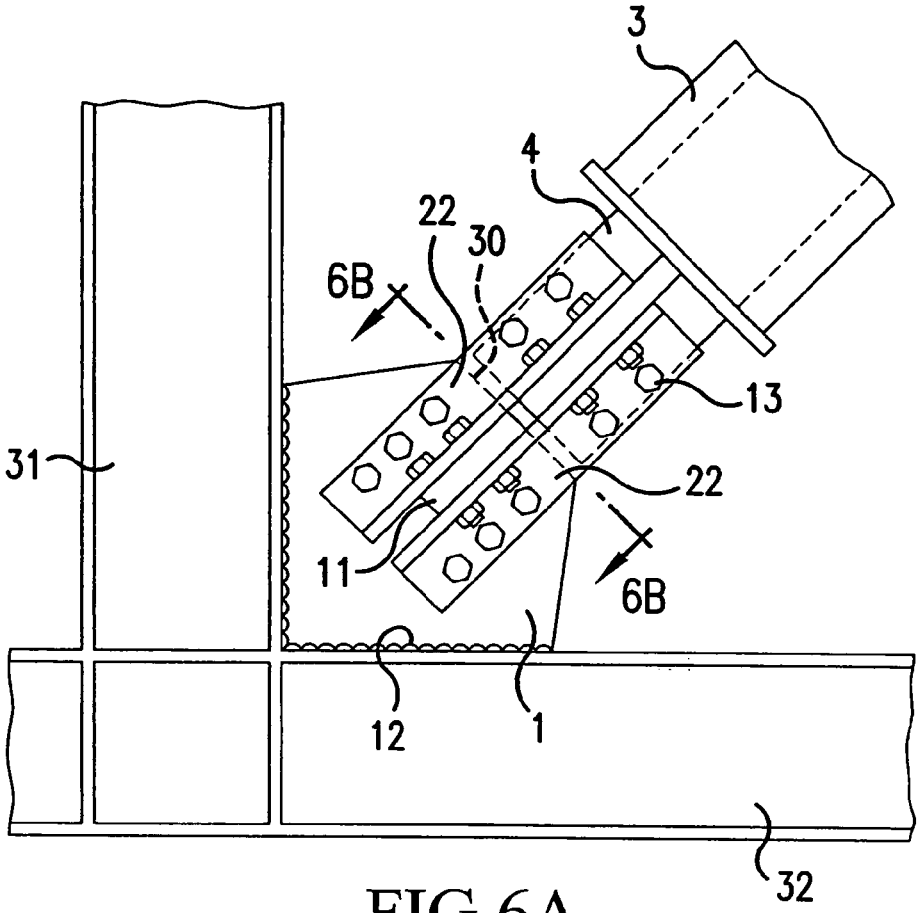
FIG. 6A is a side view illustrating a joint structure for increasing earthquake resistance with an existing gusset plate according to embodiment 3 of the present invention.
Figure 6B:
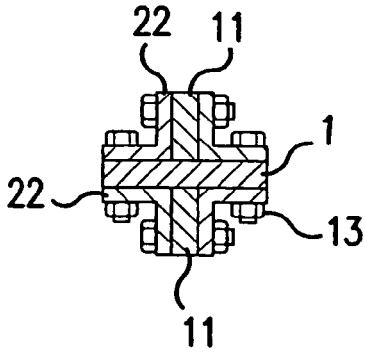
FIG. 6B is a cross sectional view taken along the line 6B-6B of FIG. 6A.
Figure 7A:
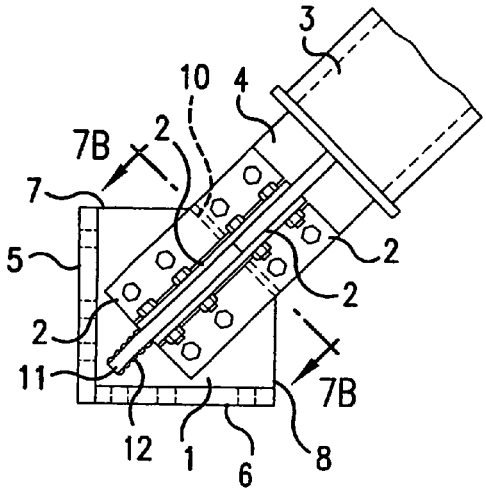
FIG.7A BACKGROUND ART
FIGS. 7A and 7C are side views illustrating a joint structure including a gusset plate and a splice plate according to examples 1 and 2, respectively, of the background art.
Figure 7C:
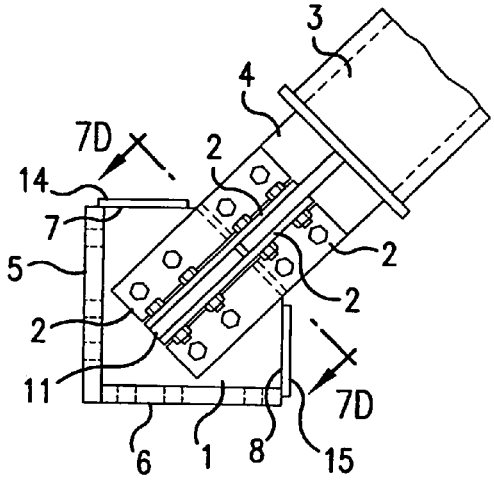
FIG.7C BACKGROUND ART
Figure 7B:
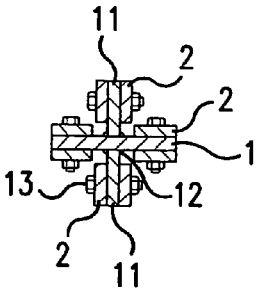
FIG.7B BACKGROUND ART
FIG. 7B is a cross sectional views taken along the line 7B-7B of FIG. 7A.
Figure 7D:
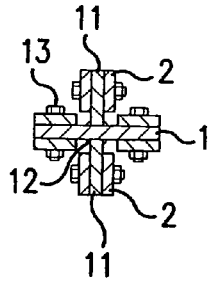
FIG.7D BACKGROUND ART
FIG. 7D is a cross sectional view taken along the line 7D-7D of FIG. 7C.
Figure 8A:
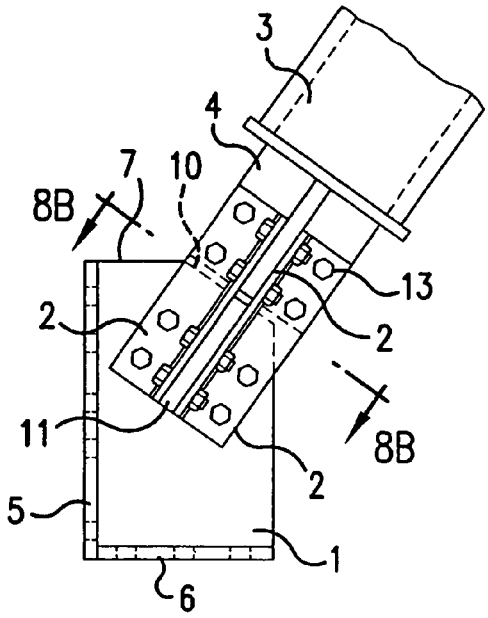
FIG.8A BACKGROUND ART
FIGS. 8A and 8C are side views illustrating a joint structure including a gusset plate and a splice plate according to examples 3 and 4, respectively, of the background art.
Figure 8C:
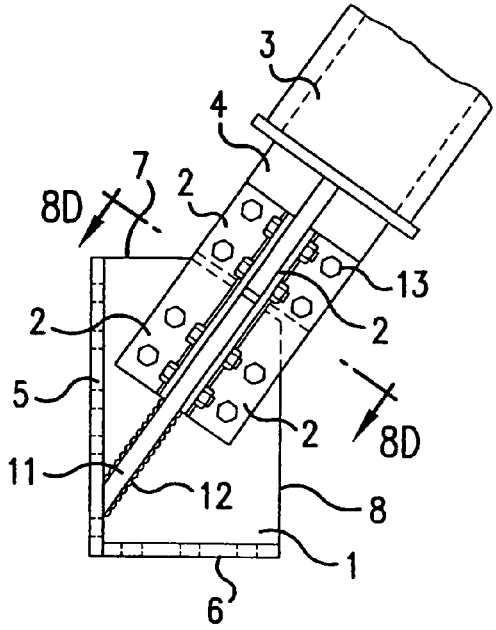
FIG.8C BACKGROUND ART
Figure 8B:
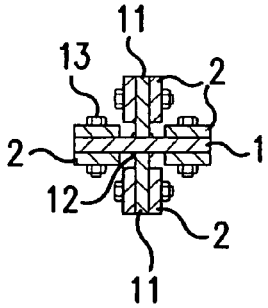
FIG.8B BACKGROUND ART
FIG. 8B is a cross sectional view taken along the line 8B-8B of FIG. 8A.
Figure 8D:
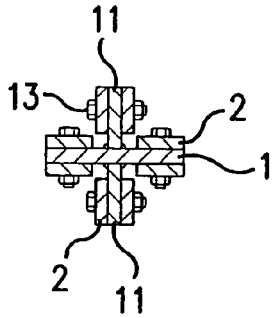
FIG.8D BACKGROUND ART
FIG. 8D is a cross sectional view taken along the line 8D-8D of FIG. 8C.

FIGS. 6A and 6B illustrate embodiment 3 of the present invention for increasing earthquake resistance of an existing building. Two edges of an existing gusset plate 1 form a right angle and are fixed to a column 31 and a beam 32 by weld 12. A stiffening rib plate 11 is welded to opposite sides of the gusset plate 1. In addition, lower portions of four splice plates 22 of the present invention having an L-shaped cross-section are fitted in the four corners of the gusset plate 1 and the stiffening ribs 11, respectively. The remaining upper portions of the four splice plates are fitted in the four corners of the joint end part 4 of the vibration damping brace 3 having a cruciform cross-section. The splice plates 22 are fixed to the gusset plate 1 and the joining end part 4 with bolts 13, respectively. Thus an existing gusset plate 1 can be reinforced without having an additional stiffening rib welded to the gusset plate on site, which leads to simple reinforcement of an existing building with lower cost.

Furthermore, the splice plate 22 of the present invention, which has a non-rectangular cross-section, is formed by adding a rib to a flat plate and/or by using prefabricated section steel. As mentioned above, the term prefabricated section steel has been used in the present specification to include section steel formed by connecting two or more plates together to form a splice plate having a non-rectangular cross-section, while the plates are off the assembly site.

Figure 9A:
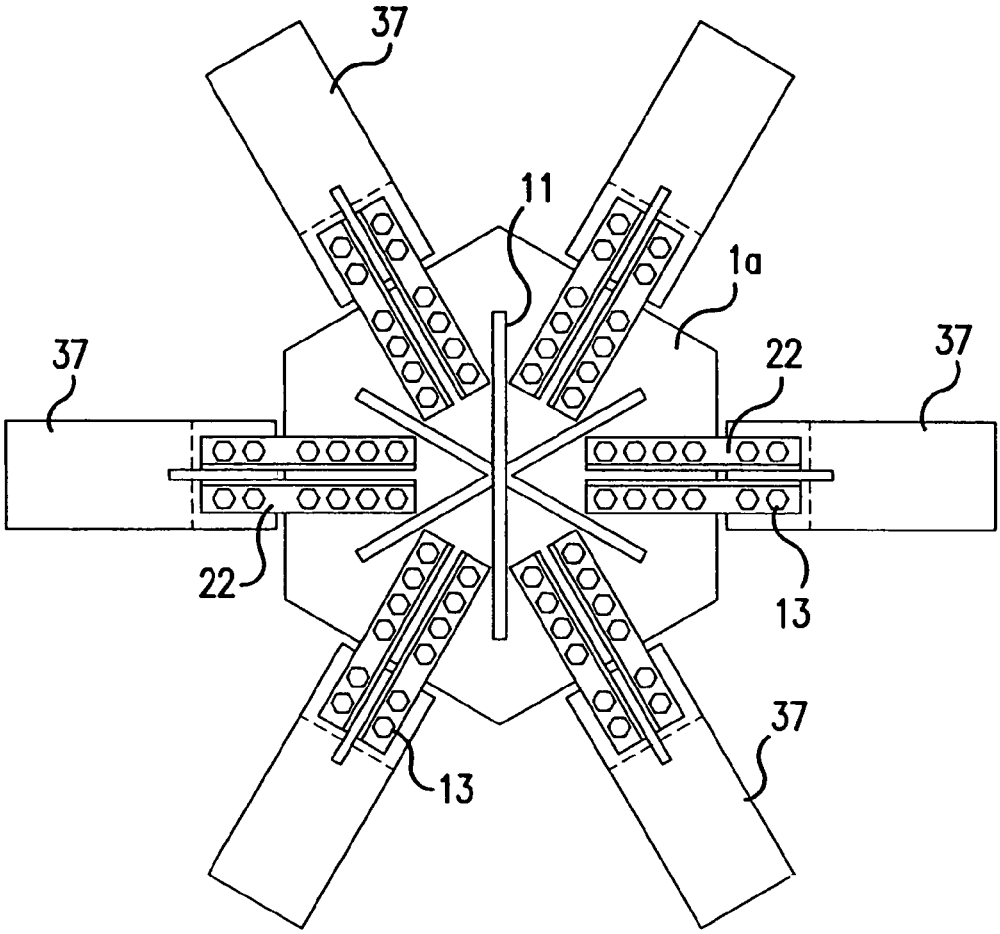
FIG. 9A is a top plan view illustrating a joint structure of the present invention used for connecting a roof truss member and a gusset plate.
Figure 9B:
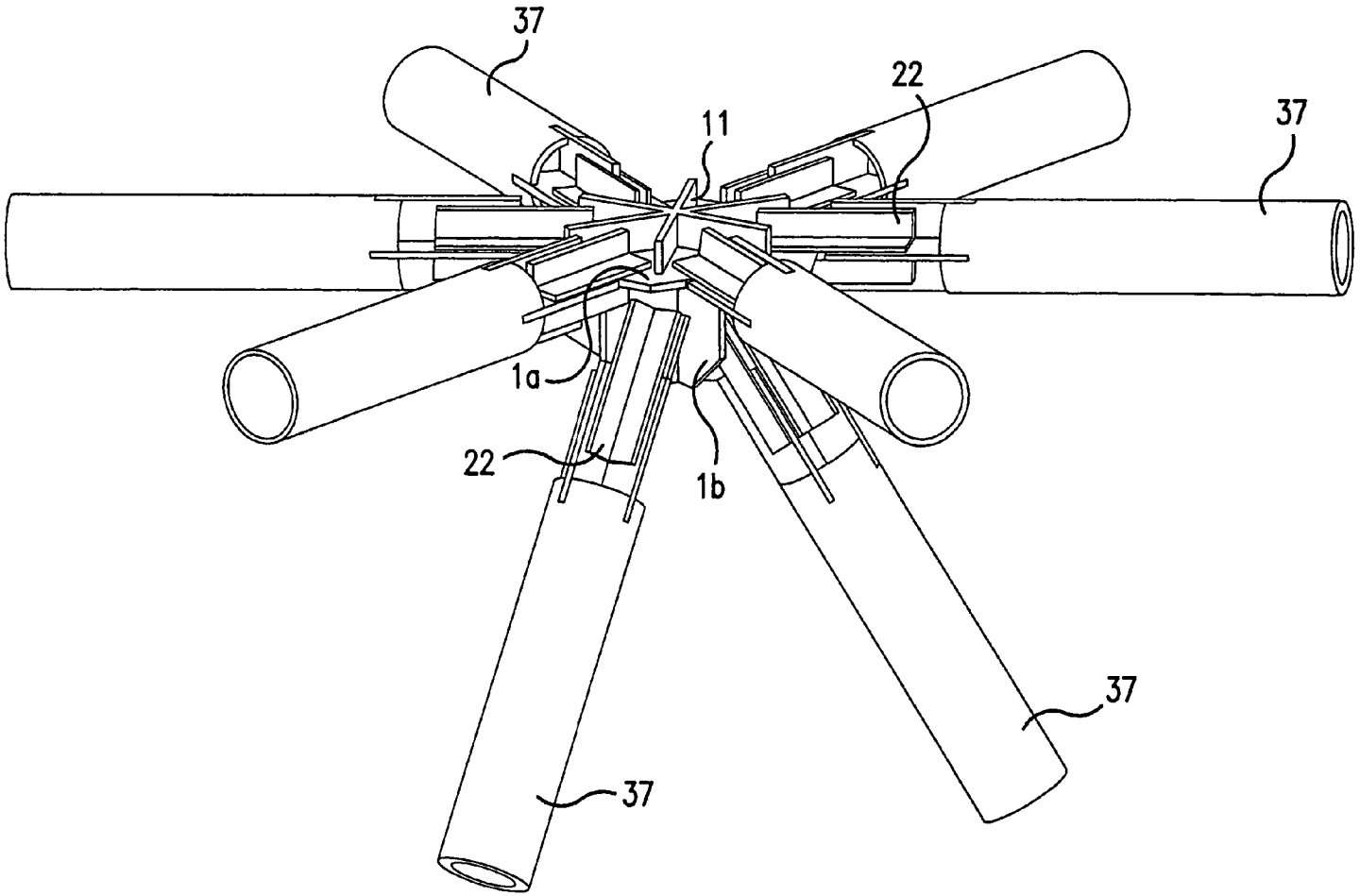
FIG. 9B is a perspective view of FIG. 9A.

Referring to FIGS. 9A and 9B, end parts of a plurality of truss members 37, used for forming a roof of a building, can be spliced to a single gusset plate 1*a*, 1*b*. In FIG. 9A, a top of a horizontal gusset plate la is illustrated with six truss members 37 attached thereto using the splice plates 22 of the present invention. In FIG. 9B, additional truss members 37 are secured to vertical gusset plates lb. As can be clearly understood, the horizontal gusset plate la and the vertical gusset plates 1*b* are connected to each other and to truss members 37 by the splice plates 22. However, the horizontal gusset plate 1*a* and the vertical gusset plates 1*b* are not connected to any other structural members. The horizontal gusset plate la and the vertical gusset plate 1*b* can be connected together by any known means, including but not limited to bolting and welding.

It should be noted that although the vertical gusset plates 1*b* are illustrated as being separate gusset plates having the shape of a fin, the vertical gusset plates can be formed from a plurality of vertical gusset plates connected together to form one gusset plate having multiple fin-shaped portions.

Figure 9C:
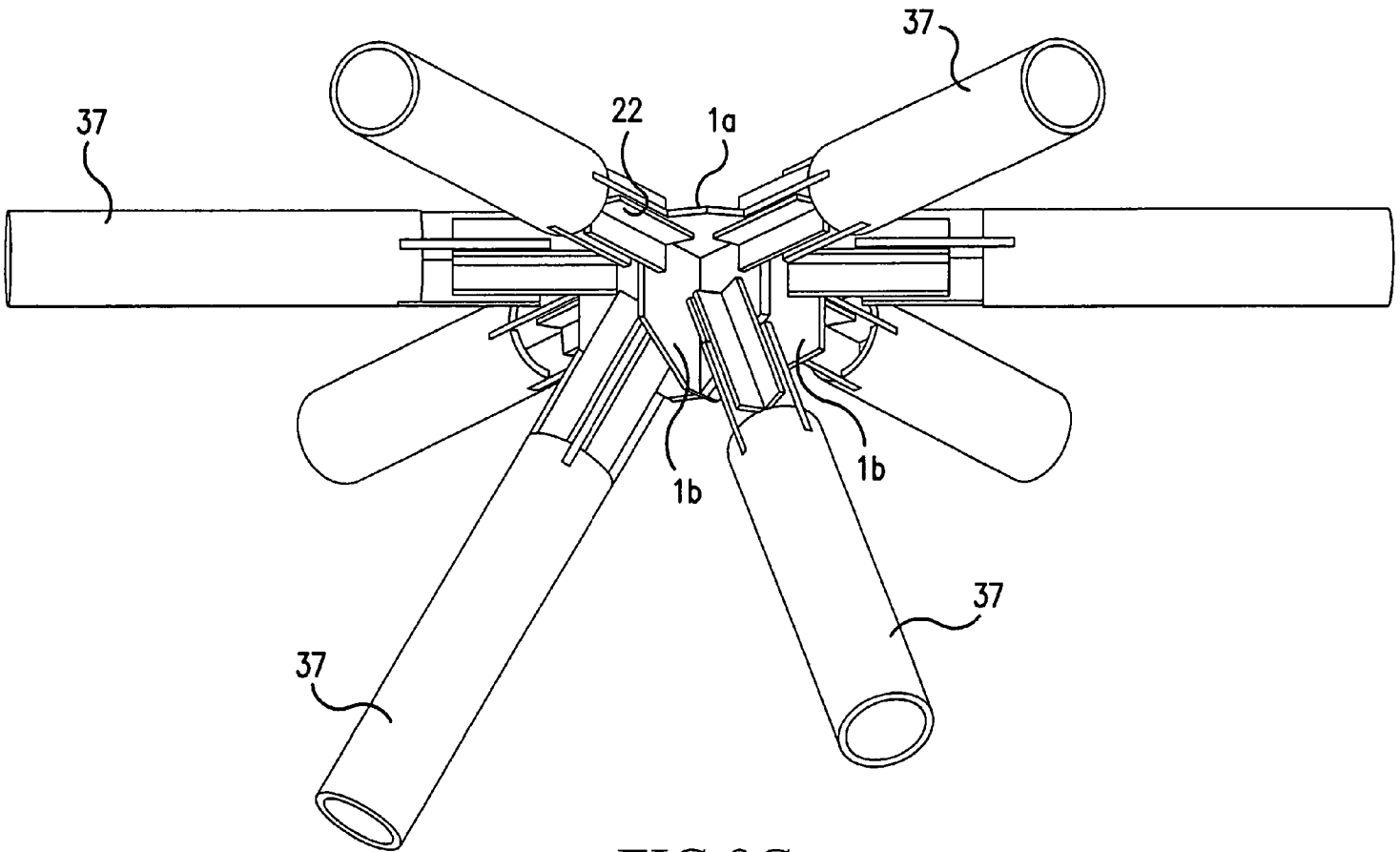
FIGS. 9C and 9D are perspective views of a joint structure of the present invention used for connecting a roof truss member and a gusset plate, wherein the gusset plate does not include a rib.
Figure 9D:
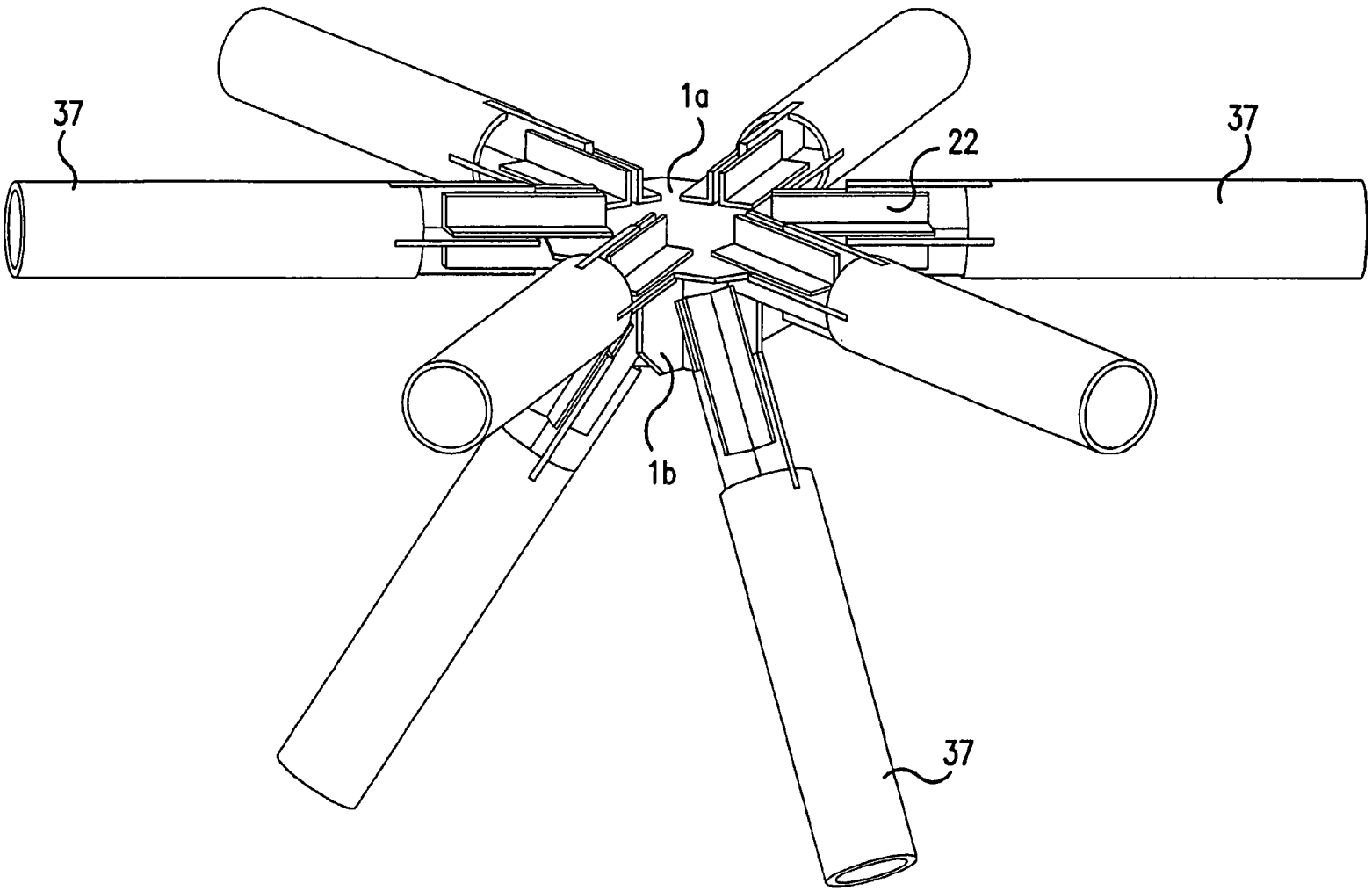

In FIGS. 9A and 9B, the horizontal gusset plate 1 includes stiffening ribs 11 attached to an upper surface thereof. Referring to FIGS. 9C and 9D, an alternative arrangement of the embodiment illustrated in FIGS. 9A and 9B is illustrated. FIGS. 9C and 9D are perspective views from below and above the horizontal gusset plate 1*a*, respectively. As can be clearly understood, the arrangement of FIGS. 9C and 9D is the same as the embodiment of FIGS. 9A and 9D, except that there are no stiffening ribs included on the horizontal gusset plate 1.

Various modifications of the embodiments and structures of the present invention such as the types of buildings and towers using the joint structures of the present invention will be understood to one having ordinary skill in the art and are within the scope of the present invention.

In the joint structure of the present invention, a splice plate for splicing a gusset plate and a joining end part of a diagonal member has a non-rectangular cross-section, which is formed by adding a rib to a flat plate and/or by using prefabricated section steel. The splice plate is fixed to both the gusset plate and the diagonal member with bolts. Therefore, the gusset plate can be easily reinforced by a splice plate having a simple-structure. This prevents the gusset plate from experiencing out-of-plane buckling and/or out-of-plane deformation, even if the stiffening rib plate of the background art is not welded to the gusset plate. Accordingly, there is no need to weld a stiffening rib plate to the gusset plate. This leads to a lower cost and avoids a low quality product caused by insufficient welding. In the situation where a stiffening rib plate is already provided, the gusset plate can still experience buckling if the rib plate is too short. This is especially true when the stiffening rib plate does not extend beyond the inclined line 24 (see FIGS. 1A-1C). The splice plate of the present invention can be used in combination with the existing stiffening rib plate to provide further buckling strength to the gusset plate and prevent out-of-plane buckling.

In order to increase the earthquake resistance of a building, if the gusset plate has no stiffening rib thereon, a stiffening rib has to be welded on site to the gusset plate. According to the present invention, it is unnecessary to weld a stiffening rib plate to the gusset plate to avoid out-of-plane buckling. This leads to a reduction in cost of the joint structure and therefore the cost of the building reinforcement. Furthermore, the buckling strength of the gusset plate can be increased by providing a splice plate fixed to the gusset plate and having a sufficient length so as to have a sufficient buckling strength.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A joint structure, comprising:

a gusset plate, said gusset plate being formed from a flat plate having first and second opposed faces and first and second opposed vertical edges; and a plurality of splice plates connected to said gusset plate, each of said plurality of splice plates being constructed from section steel having a cross-section perpendicular to a longitudinal axis thereof that is L-shaped, at least one of said plurality of splice plates having a face in direct contact with the first opposed face of said gusset plate and at least another of said plurality of splice plates having a face in direct contact with the second opposed face of said gusset plate, wherein none of the plurality of splice plates cross the first and second vertical edges of the gusset plate.

2. The joint structure according to claim 1, wherein said gusset plate is connectable to a first structural member and said plurality of splice plates is connectable to a second structural member.

3. The joint structure according to claim 1, wherein said gusset plate connected to said plurality of splice plates is a first gusset plate, said first gusset plate being connectable to a second gusset plate.

4. The joint structure according to claim 3, wherein said first gusset plate is a vertical gusset plate and said second gusset plate is a horizontal gusset plate, said horizontal gusset plate being connected to at a least one additional splice plate constructed from section steel having a non-rectangular cross-section.

5. The joint structure according to claim 1, wherein said section steel is prefabricated section steel having a non-rectangular cross-section.

6. The joint structure according to claim 5, wherein said prefabricated section steel having a non-rectangular cross-section is formed off site by connecting at least one rib to a flat plate.

7. The joint structure according to claim 1, wherein the gusset plate includes a rib connected to at least one of a top edge and the second vertical edge thereof to increase the buckling strength of the gusset plate.

8. The joint structure according to claim 1, wherein said gusset plate includes a first joining plate connected to the first vertical edge thereof and a second joining plate connected to a horizontal edge thereof, and at least one of said plurality of splice plates extends toward a corner of the gusset plate beyond a yield line of the gusset plate to increase the buckling strength of the gusset plate, said yield line being formed by a diagonal line extending from an edge of the first joining plate to an edge of the second joining plate.

9. The joint structure according to claim 1, wherein said gusset plate includes said first and second opposed faces and said first and second vertical edges, said first and second vertical edges being connected by a top inclined edge and an end edge, and said inclined edge and said second vertical edge having a rib connected thereto and said first and second opposed faces having no stiffening ribs connected thereto.

10. The joint structure according to claim 1, wherein said gusset plate includes said first and second opposed faces, a first joining plate connected to the first vertical edge thereof and a second joining plate connected to a horizontal edge thereof, each of said first and second opposed faces having a stiffening rib connected thereto, and said stiffening ribs do not extend beyond a yield line of the gusset plate, said yield line being formed by a diagonal line extending from an edge of the first joining plate to an edge of the second joining plate.

11. The joint structure according to claim 10, wherein said gusset plate includes a top inclined edge and an end edge, said top inclined edge and said second vertical edge being connected by said end edge, said end edge having a stiffening rib connected thereto.

12. The joint structure according to claim 1, wherein said gusset plate includes said first and second opposed faces, said first and second opposed faces having no stiffening ribs connected thereto.

13. The joint structure according to claim 1, said gusset plate further comprising a top inclined edge and an end edge connecting said first and second opposed vertical edges together, and said plurality of splice plates cross the end edge of the gusset plate.

14. A building, comprising:

at least one structural member; and a joint structure connected to said at least one structural member, said joint structure comprising:

a gusset plate, said gusset plate being formed from a flat plate having first and second opposed faces and first and second vertical edges; and a plurality of splice plates connected to said gusset plate, each of said plurality of splice plates being constructed from section steel having a cross-section perpendicular to a longitudinal axis thereof that is L-shaped, at least one of said plurality of splice plates having a face in direct contact with the first opposed face of said gusset plate and at least another of said plurality of splice plates having a face in direct contact with the second opposed face of said gusset plates, wherein none of the plurality of splice plates cross the first and second vertical edges of the gusset plate.

15. The building according to claim 14, wherein said gusset plate is connected to a first of said structural members and said plurality of splice plates is connected to a second of said structural members.

16. The joint structure according to claim 14, wherein said gusset plate connected to said plurality of splice plate is a first gusset plate, said first gusset plate being connectable to a second gusset plate.

17. The joint structure according to claim 16, wherein said first gusset plate is a vertical gusset plate and said second gusset plate is a horizontal gusset plate, said horizontal gusset plate being connected to at a least one additional splice plate constructed from section steel having a non-rectangular cross-section.

18. The building according to claim 14, wherein said section steel is prefabricated section steel having a non-rectangular cross-section.

19. The building according to claim 18, wherein said prefabricated section steel having a non-rectangular cross-section is formed off site by connecting at least one rib to a flat plate.

20. The building according to claim 14, wherein the gusset plate includes a rib connected to at least one of a top edge and the second vertical edge thereof to increase the buckling strength of the gusset plate.

21. The building according to claim 14, wherein said gusset plate includes a first joining plate connected to the first vertical edge thereof and a second joining plate connected to a horizontal edge thereof, and at least one of said plurality of splice plates extends toward a corner of the gusset plate beyond a yield line of the gusset plate to increase the buckling strength of the gusset plate, said yield line being formed by a diagonal line extending from an edge of the first joining plate to an edge of the second joining plate.

22. The building according to claim 14, wherein said gusset plate includes said first and second opposed faces and said first and second vertical edges, said first and second vertical edges being connected by a top inclined edge and an end edge, and said inclined edge and said second vertical edge having a rib connected thereto and said first and second opposed faces having no stiffening ribs connected thereto.

23. The building according to claim 14, wherein said gusset plate includes said first and second opposed faces, a first joining plate connected to the first vertical edge thereof and a second joining plate connected to a horizontal edge thereof, each of said first and second opposed faces having a stiffening rib connected thereto, and said stiffening ribs do not extend beyond a yield line of the gusset plate, said yield line being formed by a diagonal line extending from an edge of the first joining plate to an edge of the second joining plate.

24. The building according to claim 23, wherein said gusset plate includes a top inclined edge and an end edge, said top inclined edge and said second vertical edge being connected by said end edge, said end edge having a stiffening rib connected thereto.

25. The building according to claim 14, wherein said gusset plate includes said first and second opposed faces, said first and second opposed faces having no stiffening ribs connected thereto.

26. The building according to claim 14, said gusset plate further comprising a top inclined edge and an end edge connecting said first and second opposed vertical edges together, and said plurality of splice plates cross the end edge of the gusset plate.

27. A method of assembling or reinforcing a building, comprising the steps of:

providing a gusset plate, said gusset plate being formed from a flat plate having first and second opposed faces and first and second opposed vertical edges;

providing a plurality of splice plates, said plurality of splice plates having a cross-section perpendicular to a longitudinal axis thereof that is L-shaped; and connecting a first end of each of said plurality of splice plates to said gusset plate such that at least one of said plurality of splice plates has a face in direct contact with the first opposed face of said gusset plate and at least another of said plurality of splice plates has a face in direct contact with the second opposed face of said gusset plates, wherein none of the plurality of splice plates cross the first and second vertical edges of the gusset plate.

28. The method according to claim 27, wherein said method does not include on site welding to assemble or reinforce the building.

29. The method according to claim 27, further comprising the step of connecting a second end of each of said plurality of splice plates to a structural member of the building.

30. The method according to claim 29, further comprising the step of connecting the gusset to a structural member of the building.

31. The method according to claim 27, wherein the gusset is a preexisting gusset attached to the building, the preexisting gusset including a stiffening rib attached thereto, said method further comprising the step of connecting said first end of at least one of said plurality of splice plates to the stiffening rib of the preexisting gusset.

32. The method according to claim 27, wherein said gusset plate connected to said plurality of splice plates is a first gusset plate, said method further comprising the step of connecting said first gusset plate to a second gusset plate.

33. The method according to claim 32, wherein said first gusset plate is a vertical gusset plate and said second gusset plate is a horizontal gusset plate, said method further comprising the step of connecting said horizontal gusset plate to at least one additional splice plate.

34. The method according to claim 27, wherein said gusset plate includes a first joining plate connected to the first vertical edge thereof and a second joining plate connected to a horizontal edge thereof, said method further comprising the step of extending said at least one of said plurality of splice plates toward a corner of the gusset plate beyond a yield line of the gusset plate to increase the buckling strength of the gusset plate, said yield line being formed by a diagonal line extending from an edge of the first joining plate to an edge of the second joining plate.

35. The method according to claim 27, wherein said gusset plate further comprises a top inclined edge and an end edge connecting said first and second opposed vertical edges together, said method further comprises the step of crossing said plurality of splice plates across the end edge of the gusset plate.

* * * * *